US006401873B1

(12) United States Patent
Mustalahti et al.

(10) Patent No.: US 6,401,873 B1
(45) Date of Patent: Jun. 11, 2002

(54) ELEVATOR ARRANGEMENT FOR SETTING THE STARTING TORQUE OF THE MOTOR OF AN ELEVATOR MACHINERY WHICH USES AT LEAST ONE SENSOR FOR DETERMINING THE IMBALANCE MOMENT OF CAR LOAD

(75) Inventors: Jorma Mustalahti, Hyvinkaa; Esko Aulanko, Kerava; Harri Hakala, Hyvinkaa, all of (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/786,201

(22) PCT Filed: Sep. 2, 1999

(86) PCT No.: PCT/FI99/00714

§ 371 (c)(1),
(2), (4) Date: Mar. 27, 2001

(87) PCT Pub. No.: WO00/14004

PCT Pub. Date: Mar. 16, 2000

(30) Foreign Application Priority Data

Sep. 4, 1998 (FI) ..... 981887

(51) Int. Cl.[7] ..... B66B 1/44
(52) U.S. Cl. ..... 187/292; 187/393
(58) Field of Search ..... 187/296, 409, 187/411, 393, 394

(56) References Cited

U.S. PATENT DOCUMENTS

| | | | | | |
|---|---|---|---|---|---|
| 3,323,606 | A | * | 6/1967 | Bruns et al. | 187/292 |
| 4,766,977 | A | * | 8/1988 | Yamasaki | 187/20 |
| 4,995,478 | A | | 2/1991 | Oshima et al. | |
| 5,156,239 | A | * | 10/1992 | Ericson et al. | 187/73 |
| 5,233,139 | A | * | 8/1993 | Hofmann | 187/116 |
| 5,407,030 | A | | 4/1995 | Burton et al. | |
| 5,862,886 | A | * | 1/1999 | Bennett et al. | 187/292 |
| 5,896,949 | A | * | 4/1999 | Hamdy et al. | 187/292 |
| 5,899,301 | A | * | 5/1999 | Aulanko et al. | 187/266 |
| 6,021,873 | A | * | 2/2000 | Aulanko et al. | 187/411 |
| 6,026,937 | A | * | 2/2000 | Hayashi et al. | 187/401 |
| 6,234,276 | B1 | * | 5/2001 | Wagatsuma et al. | 187/411 |
| 6,305,503 | B1 | * | 10/2001 | Suzuki et al. | 187/393 |

FOREIGN PATENT DOCUMENTS

EP 0688735 A2 12/1995

* cited by examiner

*Primary Examiner*—Jonathan Salata
(74) *Attorney, Agent, or Firm*—Birch, Stewart, Kolasch & Birch, LLP

(57) ABSTRACT

Elevator arrangement for setting the starting torque of the motor of an elevator machinery, the elevator machinery being mounted on a guide rail in an elevator shaft. The elevator arrangement has at least one power sensor for determining the imbalance moment that the car load produces in the elevator machinery.

5 Claims, 4 Drawing Sheets

ELEVATOR ARRANGEMENT FOR SETTING THE STARTING TORQUE OF THE MOTOR OF AN ELEVATOR MACHINERY WHICH USES AT LEAST ONE SENSOR FOR DETERMINING THE IMBALANCE MOMENT OF CAR LOAD

This application is the national phase under 35 U.S.C. § 371 of PCT International Application No. PCT/FI99/00714 which has an International filing date of Sep. 2, 1999, which designated the United States of America.

FIELD OF THE INVENTION

The present invention relates to an arrangement for setting the starting torque of an elevator machinery.

DESCRIPTION OF THE RELATED ART

In an elevator arrangement consisting of an elevator car, a counterweight and an elevator machinery driving there, there are large variations in the imbalance moment. Generally, every time when the car stops at a landing, its load changes, causing a change in the imbalance moment of the elevator arrangement, as the starting torque of the motor of the elevator machinery must always be set in accordance with the prevailing load.

At present, the required starting torque is determined using e.g. a load weighing device in the car. In this case, a power sensor is placed between the car and the car frame to weigh the load. This structure is difficult to apply in the new elevators having a so-called frameless car structure with an integrated car and car frame. In addition, long transmission lines are needed between the car and the control system and they are exposed to various disturbances. Likewise, this design does not take the weight of the ropes and the friction on the guide rails into account.

Another alternative is to use a brake balance system. In this case, the brake torque of the elevator is measured and the starting torque is set to the same magnitude. After this, the brake is released when the motor generates a torque that brings the brake torque to zero. Although this solution works well, it is expensive because of the friction at the hinges and the non-ideality of the brake shoe.

A third alternative is to use a weighing device suspended at the end of a rope. In this case, the force acting on the point of suspension is measured. A drawback is that, in the case of 1:1 suspension, the rope end moves. This drawback is not present in 1:2 suspension, but the friction of the guides gives rise to errors.

BRIEF SUMMARY OF THE INVENTION

The object of the present invention is to eliminate the drawbacks described above. A specific object of the present invention is to disclose a new type of elevator arrangement for setting the starting torque of the motor of the an elevator machinery, an arrangement which accurately measures actual forces and which can be implemented in a simple way with few components and short transmission lines.

In the elevator arrangement of the invention for setting the starting torque of the motor of an elevator machinery, the elevator machinery is fixed to a guide rail in an elevator shaft. According to the invention, the elevator arrangement comprises at least one power sensor connected to the elevator machinery via a non-switched connection and designed to determine the imbalance moment that the prevailing car load produces in the elevator machinery.

Thus, in the elevator arrangement of the invention, no car load measurements need to be made in the car itself to determine the required starting torque of the motor, but instead the measurements can be performed using appropriate power sensors, which are placed on immobile points in the framework structures of the elevator machinery and in parts of the elevator arrangement fixedly connected to them.

Thus, one or more power sensors may be installed e.g. in places like the following: elevator machinery, guide rail fixture of the elevator machinery, beating carrier of the elevator machinery and the guide rail in the elevator shaft to which the elevator machinery is fixed.

The elevator arrangement of the invention has significant advantages as compared with prior art. It makes it possible to measure the actual forces acting on the machinery, which are not transmitted via ropes or the like and are not liable to errors e.g. due to friction. Moreover, the sensors can be mounted near the machinery and therefore also near the control equipment, so the transmission lines will be short.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention will be described in detail with reference to the attached drawings, wherein.

DETAILED DESCRIPTION OF THE INVENTION

Figure 1:
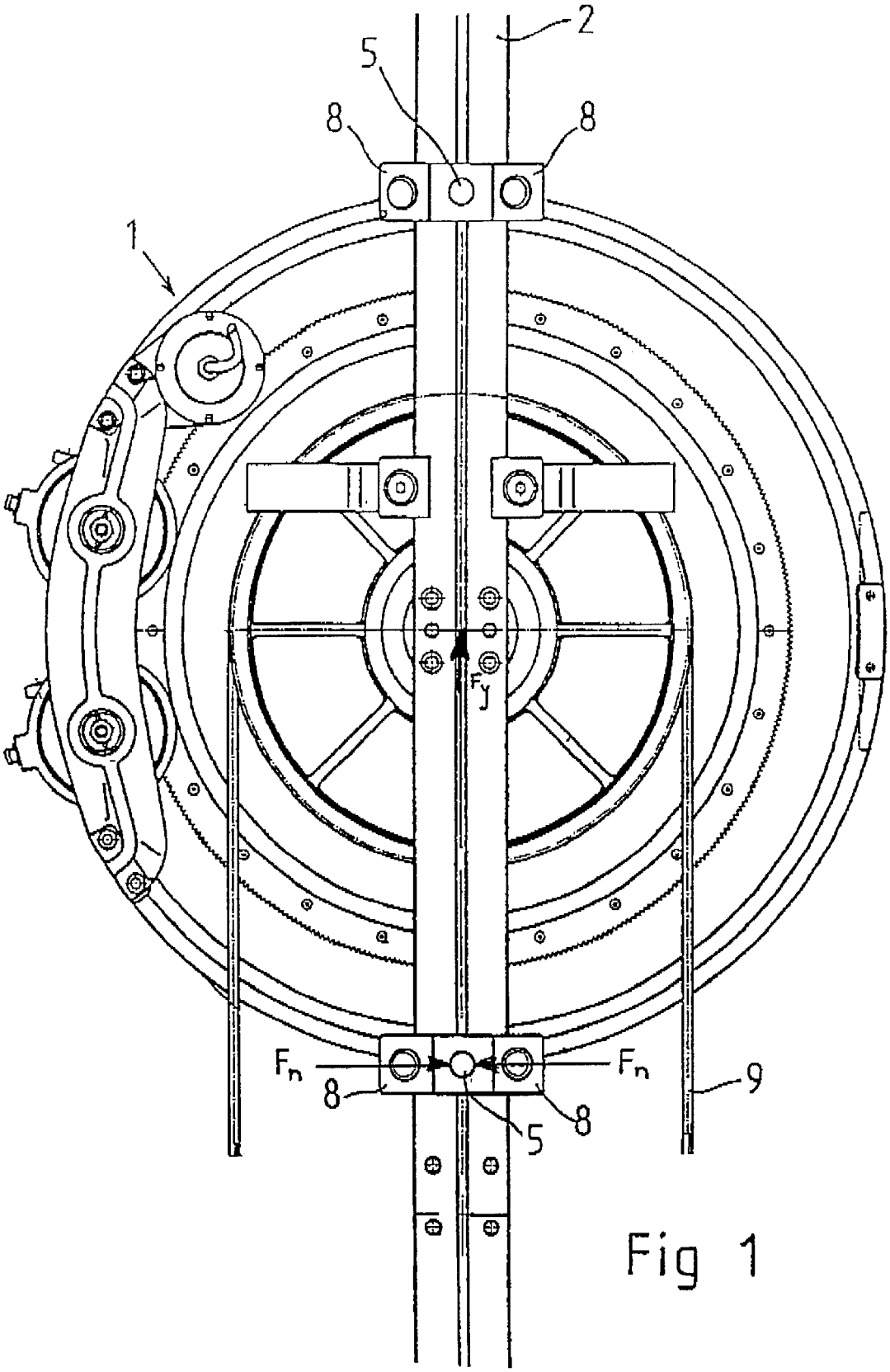
FIG. 1 presents an elevator arrangement according to the invention.

FIG. 1 presents an elevator arrangement according to the invention in which an elevator machinery 1 is fixed to a guide rial 2 in an elevator shaft by means of rail fixtures 8 holding the machinery by its upper and lower parts. Power sensors 5 according to the invention are placed in conjunction with the rail fixtures 8. When the car load changes, the magnitude and possibly also the direction of the force acting on the wire ropes 8 is/are changed as well. In FIG. 1, the center of the elevator machinery functions as a $1^{st}$ bearing, which carries the vertical forces F, and 2. The points of attachment of the power sensors 5 also function as bearing carriers, receiving the forces $P_a$ resulting from the torque. Thus, the load acting via the wire ropes produces a torsion on the machinery, and this torsion, i.e. imbalance moment, is measured by means of the power sensors 5.

Figure 2:
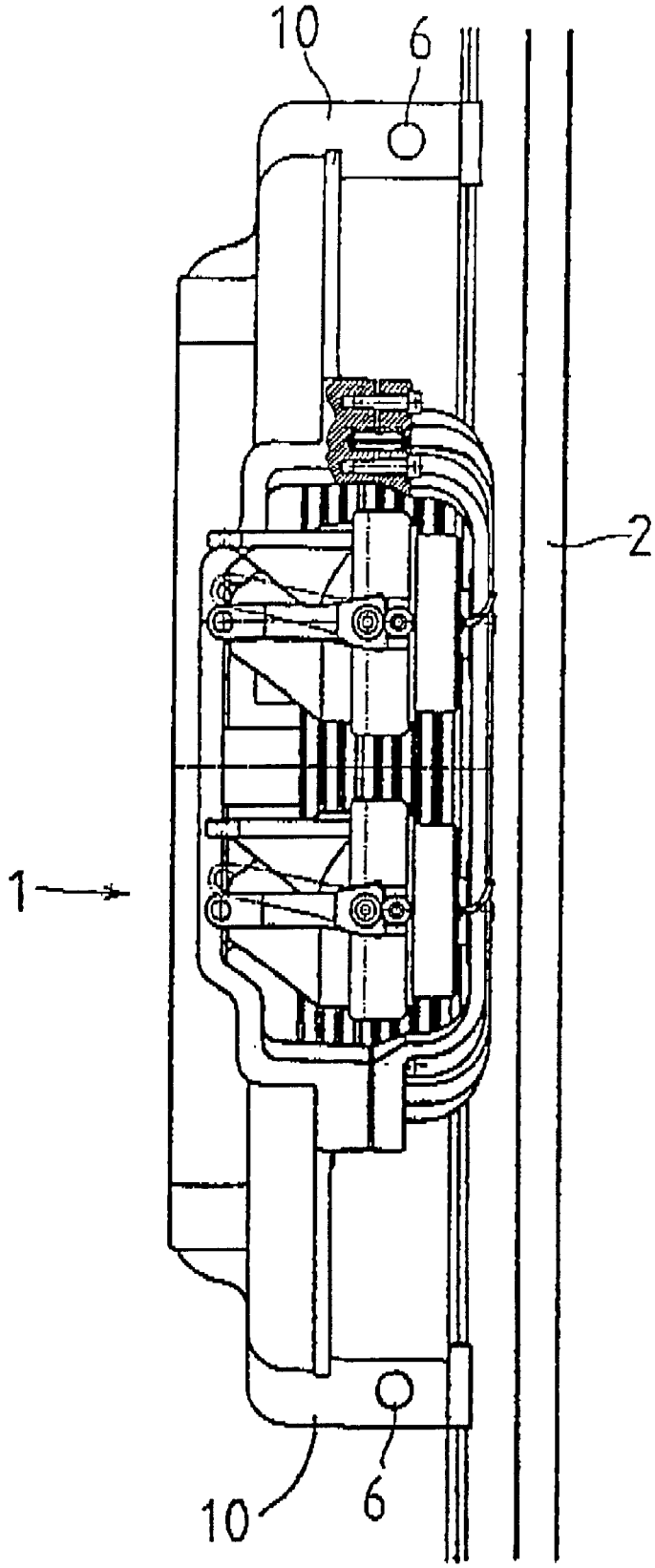
FIG. 2 presents a second elevator arrangement according to the invention.

FIG. 2 presents a second embodiment of the invention, in which the elevator machinery 1 is also fixed by two points to a guide rail 2. In this embodiment, the power sensors 6 are mounted on the elevator machinery, close to its points of attachment to the guide rail 2. The sensors 6 are mounted on suitable supporting arms or legs 10 which carry the entire elevator machinery on the guide rail 2. Thus, in a manner corresponding to FIG. 1, the imbalance moment can be measured and used to set the starting torque of the motor as appropriate.

Figure 3:
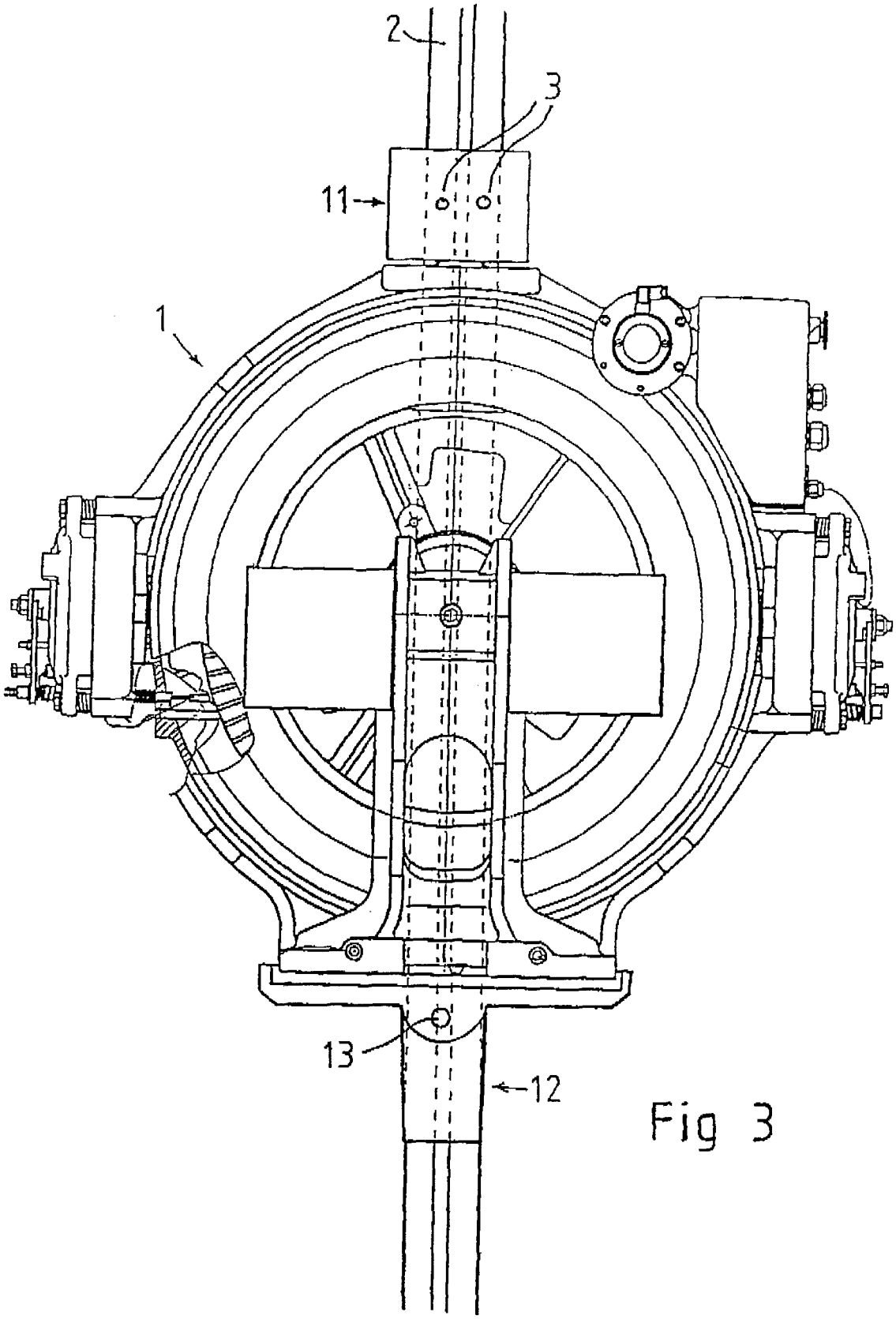
FIG. 3 presents a third elevator arrangement according to the invention.
Figure 4:
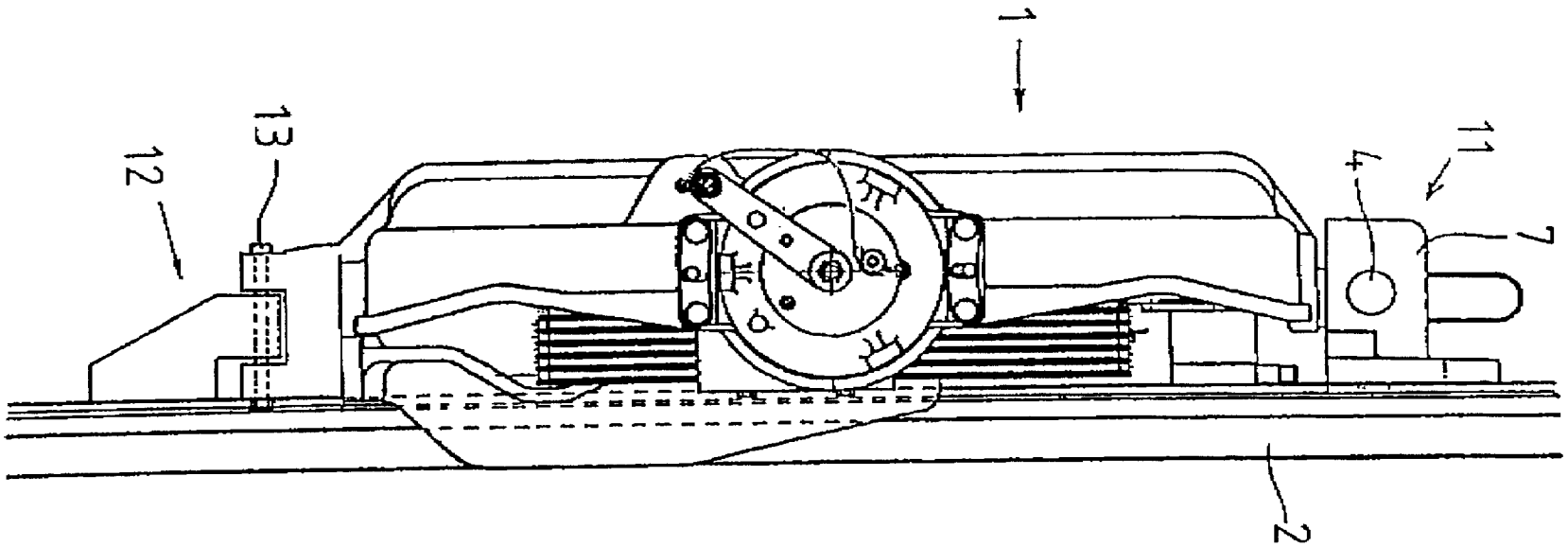
FIG. 4 presents a fourth elevator arrangement according to the invention.

FIG. 3 presents a third embodiment of the invention, in which the elevator machinery 1 is substantially fixedly attached to a guide rail 2 only by its upper part 11. In its lower part 12, the machinery is connected to the guide rail 2 by means of a fulcrum pin 13, allowing a turning motion in a vertical plane. FIG. 4 shows this mounting arrangement in side view.

The embodiment in FIG. 3 has two power sensors 3 mounted between the elevator machinery 1 and the guide rail 2, which is where a path of forces and tensions is located. When an imbalance moment, generated by the imbalance of the car and counterweight and acting via the ropes passing via the elevator machinery, is applied to the elevator machinery 1, the rigid attachment of the elevator machinery at its upper end 11 and the fulcrum pin attachment at the lower end 12 keep the elevator machinery rigidly in place. However, the fulcrum pin mounting at the lower end allows the elevator machinery to turn about the fulcrum pin 13, which means that, in a plane perpendicular to the fulcrum pin 13, the elevator machinery is ripidly held fast on the guide rail 2 only by its upper end 11. Thus, the imbalance moment acting on the ropes is transmitted from the elevator machinery to the guide rail 2 only via the upper end 11 of the elevator machinery. As the sensors 3 are placed on the guide rail near the point of attachment of the upper end 11 of the elevator machinery, the imbalance moment causes the greatest torsion of the guide rail 2 exactly in the area of the sensors 3, thus allowing the imbalance moment to be determined from them and the starting torque to be adjusted to a suitable level for the motor.

FIG. 4 presents a fourth embodiment, which corresponds to the one in FIG. 1, with a fulcrum pin 13 at the lower end 12 of the elevator machinery 1 as in FIG. 3. However, at the upper end 11 of the elevator machinery, the power sensor 4 is placed on a bearing 7 carrying the elevator machinery, i.e. on a support block supporting the elevator machinery on the guide rail 2.

In the foregoing, the invention has been described by way of example with reference to the attached drawings while different embodiments of the invention are possible within the scope of the inventive idea defined by the claims.

What is claimed is:

1. An elevator arrangement for setting starting torque of a motor of an elevator machinery comprising, a motor of the elevator machinery being mounted on a guide rail in an elevator shaft, at least one power sensor for determining imbalance moment produced by a car load on the elevator machinery, the sensor being connected to the elevator machinery by a fixed connection and being placed on an elevator guide rail fixture of the elevator machinery in the elevator shaft.

2. The elevator arrangement as defined in claim 1, wherein the power sensor is placed between the elevator machinery and the guide rial.

3. The elevator arrangement as defined in claim 1, wherein the power sensor is placed at a bearing supporting the elevator machinery.

4. The elevator arrangement as defined in claim 1, wherein the power sensor is placed on the elevator machinery.

5. The elevator arrangement as defined in claim 1, wherein the at least one power sensor comprises two power sensors.

* * * * *